US005527168A

United States Patent [19]

Juday

[11] Patent Number: 5,527,168

[45] Date of Patent: Jun. 18, 1996

[54] SUPERCHARGER AND HOUSING, BEARING PLATE AND OUTLET PORT THEREFOR

[75] Inventor: Ben S. Juday, Plainwell, Mich.

[73] Assignee: Eaton Corporation, Cleveland, Ohio

[21] Appl. No.: 285,256

[22] Filed: Aug. 3, 1994

[51] Int. Cl.[6] ..... F01C 1/16

[52] U.S. Cl. ..... 418/201.1

[58] Field of Search ..... 418/201.1, 202

[56] References Cited

U.S. PATENT DOCUMENTS

| | | | |
|---|---|---|---|
| 2,287,716 | 6/1942 | Whitfield | 230/143 |
| 3,057,543 | 10/1962 | Marsden | 418/201.1 |
| 4,768,934 | 9/1988 | Soethers | 418/1 |
| 4,828,467 | 5/1989 | Brown | 418/201.1 |
| 5,087,583 | 1/1992 | Hampton et al. | 418/201.1 |

FOREIGN PATENT DOCUMENTS

| | | | |
|---|---|---|---|
| 9110045 | 7/1991 | WIPO | 418/201.1 |

*Primary Examiner*—Charles Freay
*Attorney, Agent, or Firm*—L. J. Kasper

[57] ABSTRACT

A rotary blower (11) of the backflow type is disclosed including a housing portion (50), an inlet end wall portion (49), and a bearing plate (15), the housing portion defining cylindrical chambers (31,33) within which are disposed meshed rotors (35,37). The inlet end wall portion (49) defines an inlet port (51), and the housing portion (50) defines an outlet port (53) including a port end surface (59). The bearing plate (15) defines an end surface (29) and a relief chamber including a relief surface (29R), and the port end surface (59) is disposed in a plane defined by the relief surface (29R). As a result, resistance to the transfer of air through the blower is reduced, thus reducing required drive horsepower, and increasing the isentropic efficiency of the blower.

7 Claims, 4 Drawing Sheets

SUPERCHARGER AND HOUSING, BEARING PLATE AND OUTLET PORT THEREFOR

BACKGROUND OF THE DISCLOSURE

The present invention relates to rotary blowers of the Roots-type, and more particularly, to such blowers of the backflow-type.

As is well-known, Roots-type blowers include lobed rotors meshingly disposed in transversely overlapping cylindrical chambers defined by a housing. Spaces between adjacent unmeshed lobes of each rotor transfer volumes of air from an inlet port opening to an outlet port opening, without mechanical compression of the air in each space.

Typically, Roots-type blowers of the type described above are used as superchargers for vehicle engines wherein the engine provides the mechanical torque input to drive the lobed rotors. The volumes of air transferred to the outlet port are then utilized to provide a pressure "boost" within the intake manifold of the vehicle engine, in a manner which is well known to those skilled in the art, and is not directly relevant to the present invention.

Among the criteria used in evaluating a Roots blower supercharger are the horsepower required to transfer a particular volume of air under certain operating conditions, and the extent to which the temperature of the air being transferred increases as it flows through the supercharger. Such increases in the temperature of the air being transferred are reflected in a decrease in the isentropic efficiency (also referred to as the adiabatic efficiency) as will be described in greater detail subsequently.

The horsepower required to drive the supercharger is clearly understood to represent a horsepower "loss", from the viewpoint of the horsepower output of the engine, and therefore, it is desirable to minimize the required drive horsepower. In the case of the increase in air temperature as the air is transferred through the supercharger, such temperature increase also represents a horsepower loss. Typically, vehicles equipped with accessories such as superchargers have included an intercooler, one function of which is to cool the air which is being transferred by the supercharger to the engine. The warmer the air passing through the intercooler, the more horsepower is consumed by the intercooler in bringing the air temperature down to the desired temperature for optimum engine efficiency.

Much development has been done by the assignee of the present invention to improve the volumetric efficiency of Roots blower superchargers. In particular, the development has focused upon improving the configuration of the outlet port and the inlet port, as is illustrated and described in U.S. Pat. Nos. 4,768,934 and 5,078,583, respectively. However, even greater improvements in supercharger efficiency have been sought, and in particular, there has been much effort to increase the isentropic efficiency of the supercharger. It has been recognized that, in some vehicle applications, a substantial increase in isentropic efficiency of the supercharger could make it possible to eliminate the intercooler, which would represent a major cost saving for the vehicle OEM (original equipment manufacturer).

SUMMARY OF THE INVENTION

Accordingly, it is an object of the present invention to provide an improved rotary blower of the backflow type in which the horsepower required to drive the rotary blower is substantially reduced, and at the same time, the isentropic efficiency of the blower is substantially increased.

The above and other objects of the invention are accomplished by the provision of an improved rotary blower of the backflow type comprising a housing assembly including a bearing plate portion, a housing portion, and an inlet endwall portion. The housing portion defines two parallel, transversely overlapping cylindrical chambers, the axes of the cylindrical chambers defining a longitudinal direction. The bearing plate portion defines an inside end surface, and the cylindrical chambers are bounded, at an outlet end, by the inside end surface. The housing assembly defines an inlet port disposed generally toward the inlet end wall portion, and further defines an outlet port disposed generally toward the outlet end. A pair of meshed, rotors are rotatably disposed in the cylindrical chambers, each of the rotors including lobes having lead ends disposed adjacent the inlet end wall portion, and trailing ends disposed adjacent the bearing plate portion. Meshing of the lobes of the rotors effects transfer of volumes of compressible inlet port fluid to the outlet port by means of spaces between adjacent unmeshed lobes of each rotor. The outlet port defines a port end surface oriented generally perpendicular to the longitudinal direction.

The improved rotary blower is characterized by the port end surface of the inlet port being disposed approximately in a plane defined by the inside end surface of the bearing plate portion.

In accordance with a more limited aspect of the present invention, the improved rotary blower is characterized by the trailing ends of the rotors cooperating to define a fluid exit region as said rotors rotate. The inside end surface of the bearing plate portion defines a relief chamber having a relief surface disposed axially adjacent the fluid exit region. The port end surface of the inlet port is disposed approximately in a plane defined by the relief surface.

BRIEF DESCRIPTION OF THE DRAWINGS

FIG. 6 is a graph of isentropic efficiency versus supercharger speed, comparing the prior art device with the present invention, at both a five psi boost pressure, and at a 10 psi boost pressure.

DETAILED DESCRIPTION

Figure 1:
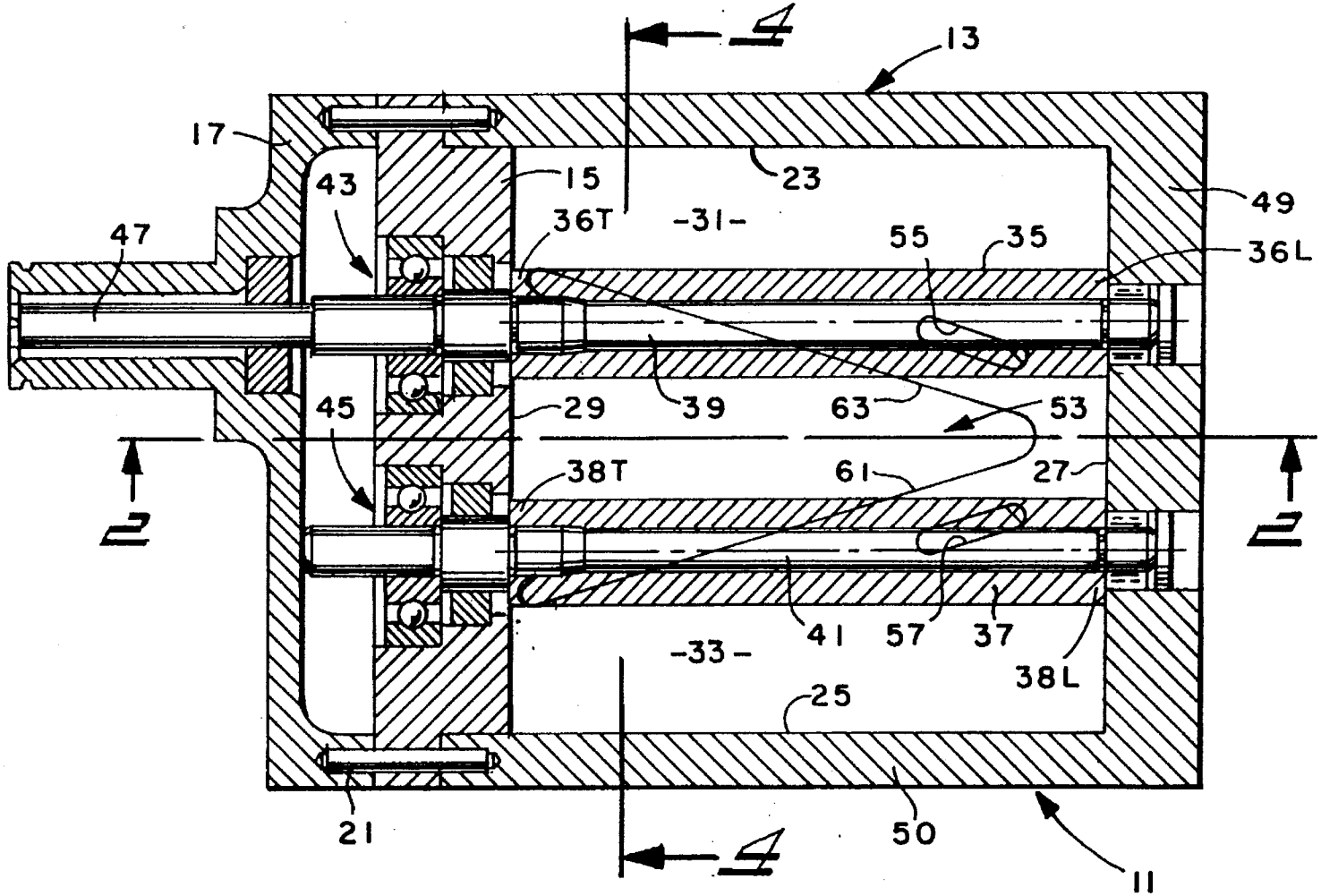
FIG. 1 is a horizontal, axial cross-section of a rotary blower of the type with which the present invention may be utilized.
Figure 2:
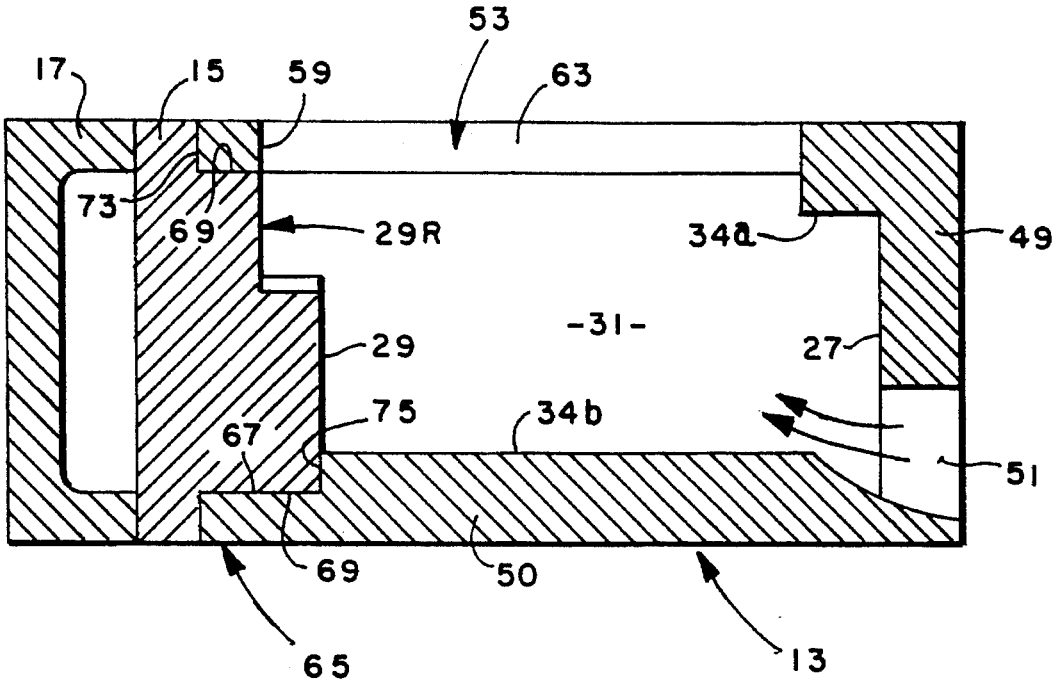
FIG. 2 is a vertical, axial cross-section, taken on line 2—2 of FIG. 1.

FIGS. 1 and 2 illustrate a rotary blower, generally designated 11, of the Roots-type. As mentioned in the background of the disclosure, such blowers are used primarily to transfer volumes of compressible fluid, such as air, from an inlet port to an outlet port without compressing the transfer volumes prior to exposure of the transfer volumes to the outlet port. The rotors operate somewhat like a gear-type pump, i.e., as the rotor teeth or lobes move out of mesh, air flows into volumes or spaces defined by adjacent lobes on each rotor. The air in these volumes is then trapped therein at substantially inlet pressure when the top lands of the trailing lobe of each transfer volume move into a sealing relationship with the cylindrical wall surfaces of the associated chamber.

The volumes of air are transferred or directly exposed to the outlet port when the top land of the leading lobe of each upcoming volume moves out of sealing relationship with the cylindrical wall surfaces by traversing the boundary of the outlet port. If helical lobes are employed, the volume of air may also be indirectly exposed to outlet port air by means of a transfer volume of the other rotor whose lead lobe has already traversed the outlet port boundary by virtue of the lead end of each helical lobe traversing the cusp defined by the intersection of the cylindrical chamber surfaces.

This indirect communication aspect of a Roots-type blower prevents mechanical compression of the transfer volume fluid and distinguishes a Roots-type blower from a conventional screw-type blower. If the volume of each transfer volume remains constant during the trip from the inlet port to the outlet port, the air therein remains substantially at inlet pressure, i.e., transfer volume air pressure remains constant if the top land of the leading lobe traverses the outlet port boundary before the volumes are squeezed by the re-meshing of the lobes. Hence, if air pressure at the discharge port is greater than inlet port pressure, outlet port air rushes or backflows into the transfer volumes as the top lands of the leading lobes traverse the outlet port boundary. Referring now primarily to FIG. 1, the rotary blower 11 is shown in some detail, although certain aspects of the rotary blower will not be illustrated or described in great detail herein because such aspects are not essential to the present invention, and are illustrated and described in great detail in U.S. Pat. Nos. 4,768,934; 4,828,467; and 5,078,583, all of which are assigned to the assignee of the present invention and incorporated herein by reference.

The rotary blower 11 includes a housing assembly comprising a main housing member 13, a bearing plate member 15, and a drive housing member 17. The three members 13, 15 and 17 are secured together by a plurality of machine screws 19 (shown in FIGS. 3 and 4), with the appropriate alignment of the three members being insured by means of a pair of dowel pins 21.

The main housing member 13 is a unitary member defining cylindrical wall surfaces 23 and 25, and a transverse end wall 27. The bearing plate member 15 defines a bearing plate end wall 29. The wall surfaces 23 and 25 and the end walls 27 and 29 together define first and second transversely overlapping cylindrical chambers 31 and 33. The cylindrical chambers 31 and 33 intersect at an upper cusp 34*a* and at a lower cusp 34*b*, in a manner well known to those skilled in the art.

Figure 4:
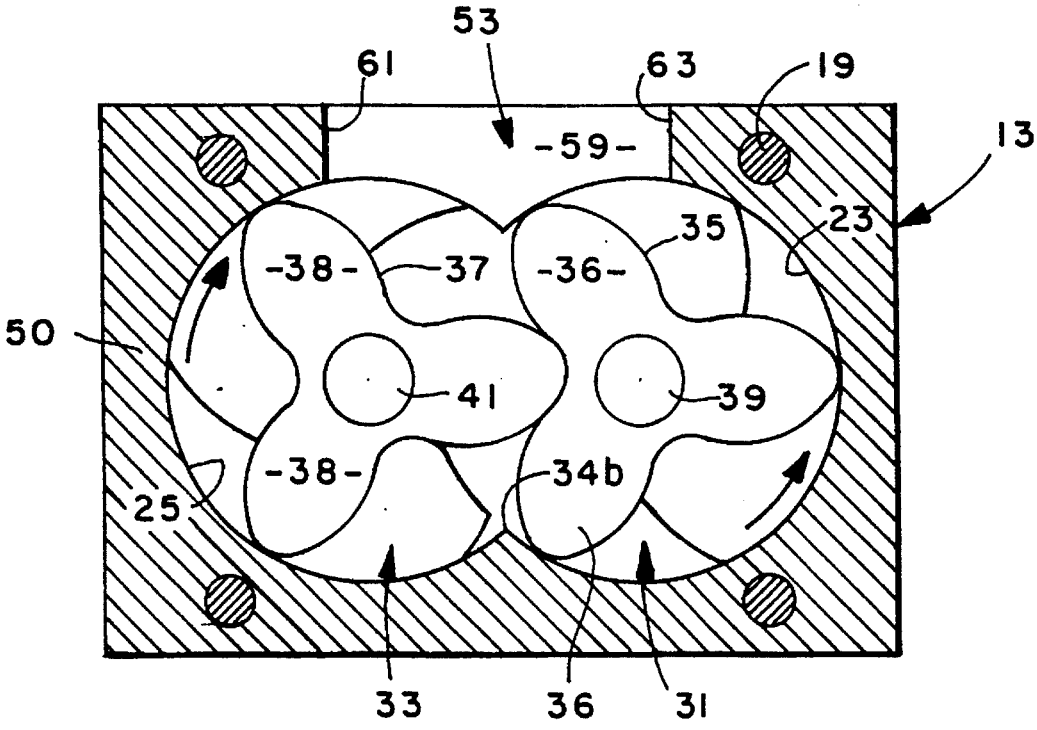
FIG. 4 is a transverse cross-section taken on line 4—4 of FIG. 1, and on substantially the same scale.
Figure 5:
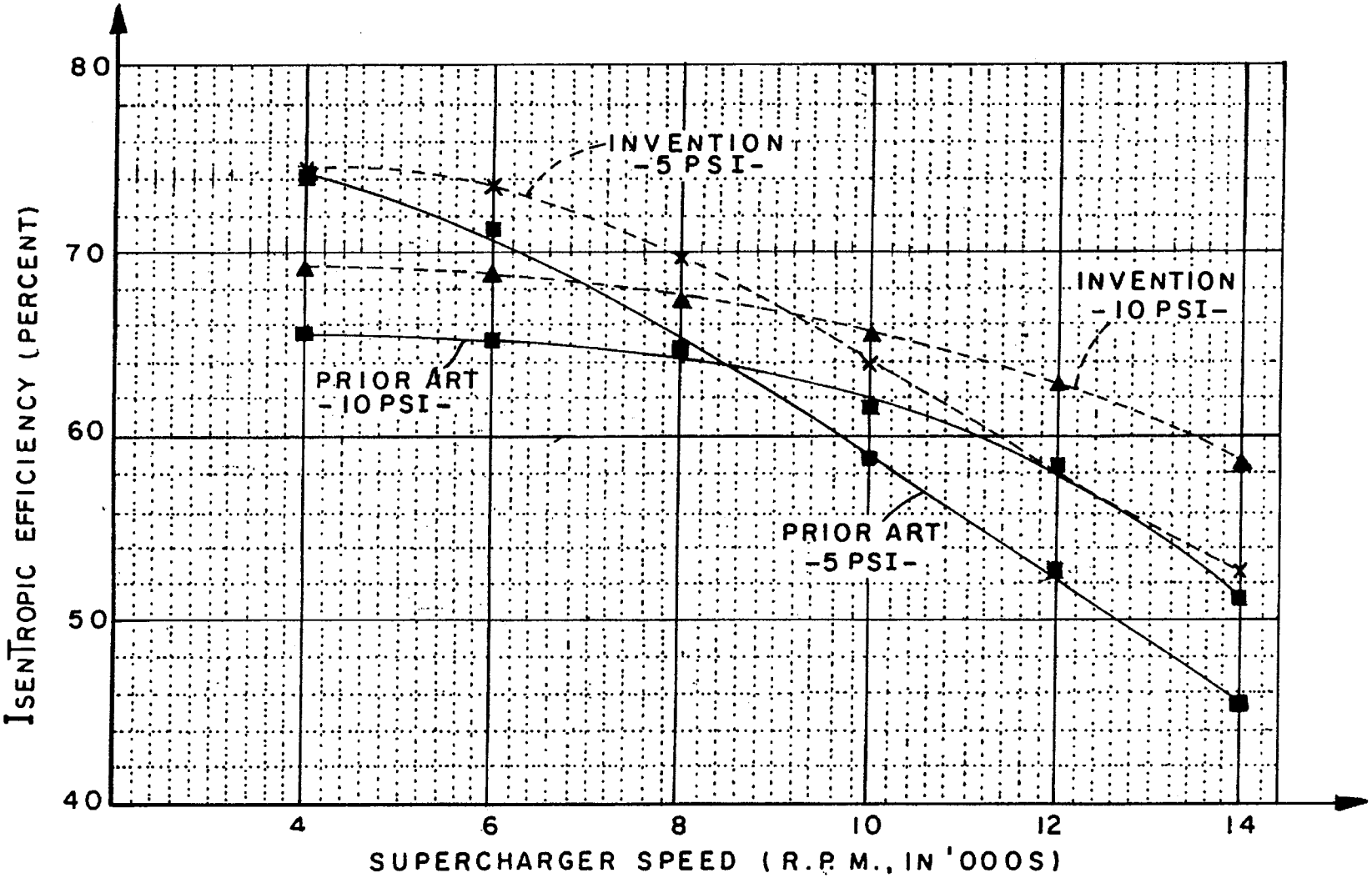

Referring now primarily to FIGS. 1 and 4, disposed within the cylindrical chambers 31 and 33 are first and second helical lobed rotors 35 and 37, respectively. Each of the rotors 35 has three lobes 36, and each of the rotors 37 has three lobes 38, the rotors 35 and 37 and the lobes 36 and 38 preferably being substantially identical except for the fact that the helical twist of the lobes 36 is opposite that of the lobes 38. The lobes 36 and 38 have leading ends 36L and 38L, respectively, and furthermore, have trailing ends 36T and 38T, respectively, as may be seen only in FIG. 1.

The rotor 35 is mounted on a rotor shaft 39 for rotation therewith, and similarly, the rotor 37 is mounted on a rotor shaft 41 for rotation therewith. A forward end of the rotor shaft 39 is rotatably supported within the bearing plate 15 by means of a bearing set 43, and similarly, the rotor shaft 41 is rotatably supported within the bearing plate 15 by means of a bearing set 45. For ease of illustration, the rotor shaft 39 is illustrated in FIG. 1 as including an input shaft portion 47, by means of which the rotary blower 11 may receive input drive torque. Those skilled in the art will understand that various other input drive configurations may be utilized, and that there are preferred arrangements for mounting the rotors 35 and 37 on the rotor shafts 39 and 41, respectively, the various details of such being illustrated and described in greater detail in above-incorporated U.S. Pat. No. 4,828,467.

Referring now primarily to FIG. 2, the main housing member 13 includes, at the right end in FIG. 2, a backplate portion 49 which is preferably formed integral with a main housing portion 50 (i.e., the portion defining the cylindrical wall surfaces 23 and 25), but could also comprise a separate plate member. The backplate portion 49 defines an inlet port 51 which is not illustrated or described in detail herein in view of the above-incorporation of U.S. Pat. No. 5,078,583. The inlet port 51, as taught in the cited patent, is typically referred to as a "high efficiency" inlet, and is preferred for use in conjunction with the structure of the present invention. However, it should be understood that the use of a high efficiency inlet port is not essential to the present invention, and that the present invention is still advantageous even when used in conjunction with a more conventional, relatively lower efficiency inlet port.

Referring now primarily to FIGS. 1, 2 and 4, the housing portion 50 defines an outlet port, generally designated 53, and disposed adjacent thereto is a pair of elongated backflow slots 55 and 57. The outlet port 53 and the slots 55 and 57 will not be described in great detail herein in view of the above-incorporation of U.S. Pat. No. 4,768,943. It should be understood by those skilled in the art that the details of the configuration of the outlet port 53 and the slots 55 and 57 are not essential features of the present invention, except to the extent noted hereinafter.

The outlet port 53, in the subject embodiment, is generally triangular in shape, and includes a port end surface 59 (see FIGS. 2 and 4), and a pair of oppositely disposed port side surfaces 61 and 63 (shown also in FIG. 1). However, it should be understood that the present invention is not limited to any particular configuration of outlet port, except as specifically noted hereinafter in the claims.

In the present invention, the aspect of the outlet port 53 which is significant is its spatial relationship to the bearing plate 15, and to the rotors 35 and 37, etc. In above-incorporated U.S. Pat. No. 4,828,467, and in those Roots blower superchargers sold by the assignee of the present invention, a forward surface of the housing portion is in an abutting relationship to the rearward surface of the bearing plate. The outlet port is separated from the end of the housing portion (typically, a distance of about 0.5 inches (12.7 mm)). The result is a "bar" disposed axially between the end surface of the outlet port and the end wall of the rotor chambers.

In accordance with an important aspect of the present invention, it has been determined that this "bar" at the end of the outlet port in prior art Roots blowers has the effect of reducing both volumetric and isentropic efficiency, and increasing the temperature differential across the blower. In the prior art blowers, this "bar" (which may typically have an axial length of about 0.5 inches (1.27 cm)) is impinged by air being transferred by the rotors toward the outlet port. It has been determined that the impingement of air against this bar has two negative aspects: first, the bar represents a resistance to the flow of air and increases the mechanical horsepower required to drive the rotors; and second, the impingement of the air against the bar raises the temperature of the air flowing through the outlet port 53, thus reducing the isentropic efficiency of the blower.

Figure 5:
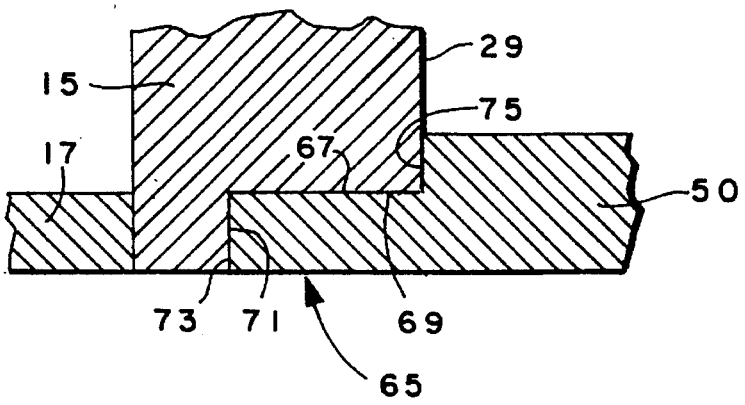
FIG. 5 is an enlarged, fragmentary axial cross-section, similar to FIG. 2, illustrating one important aspect of the present invention.

Referring now primarily to FIGS. 1, 2 and 5, the housing portion 50 includes a forward or outlet end 65 defining an internal "counterbore" 67, which functions as a receiving portion for the bearing plate 15, as will be described subsequently. The bearing plate 15 defines a stepped outer periphery 69 (see also FIG. 3) which is received within the counterbore 67. As may best be understood by viewing FIGS. 1, 2, and 4 together, the "counterbore" 67 is only truly "cut away" adjacent the lower cusp 34*b*, whereas, around the remainder of the periphery of the housing portion 50, the "counterbore" 67 is defined merely by the cylindrical wall surfaces 23 and 25 themselves.

Figure 3:
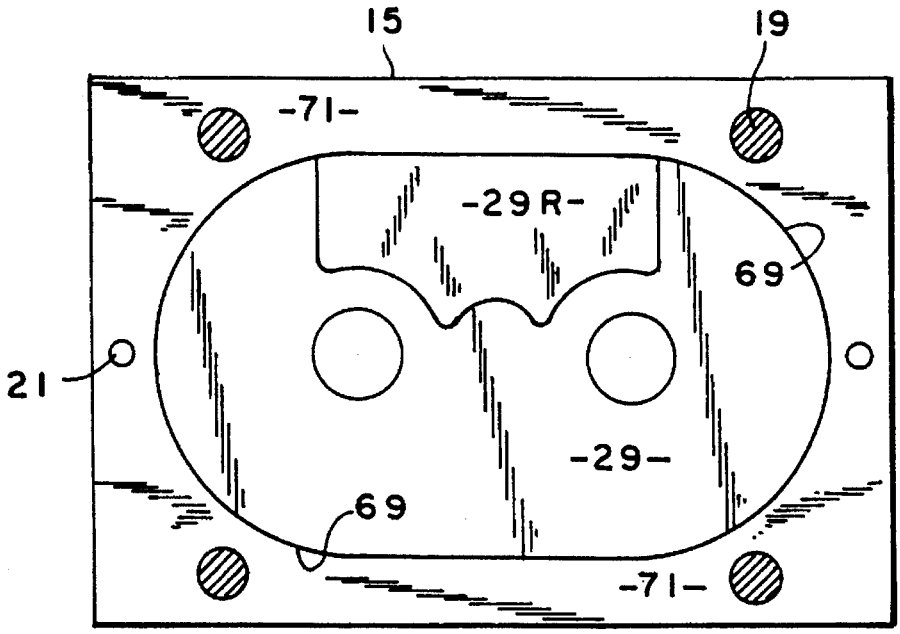
FIG. 3 is a plan view of the bearing plate member of the present invention, viewed from the right in FIG. 1, and on substantially the same scale.

In accordance with another important aspect of the present invention, and as is best seen in FIGS. 2 and 3, the bearing plate 15 defines a relief chamber, bounded toward the outlet end 65 by a relief surface 29R. The function of such a relief chamber will now be described. In a blower in which the rotor lobes are provided with a helical twist (see FIG. 4), the trailing ends 36T and 38T of the rotor lobes come into mesh to define a fluid exit region, i.e., a region of the cylindrical chamber 31 and 33 from which a certain portion of the air being transferred exits axially from the ends of the rotors (as opposed to that portion of the air which exits radially). As may best be seen in FIG. 3, this fluid exit region is generally coextensive with the relief chamber 29R (the reference numeral "29R" being used to refer to either the relief chamber or the relief surface, as appropriate).

The inclusion of the relief chamber 29R shown in FIGS. 2 and 3 is one aspect of the present invention, and has been found to be advantageous in meeting the objective of reducing drive horse power and increasing isentropic efficiency. However, it should be understood that the relief chamber 29R is not an essential feature of the present invention.

The bearing plate 15 defines a transverse surface 71, disposed radially outward from the stepped outer periphery 69. The outlet end 65 of the housing portion 50 defines a transverse surface 73 which is disposed in face-to-face engagement with the transverse surface 71. Similarly, the outlet end 65 of the housing portion 50 defines a transverse surface 75, disposed radially inward from the counterbore 67. The transverse surface 75 is disposed to be in face-to-face engagement with the end wall 29 of the bearing plate 15 although, as may be seen in FIG. 1, the transverse surface 75 does not extend around the entire periphery of the housing portion 50, but instead, in the subject embodiment, exists only in the region of the lower cusp 34*b* (see FIGS. 2 and 4).

The axial length of the "counterbore" 67 is preferably selected to be substantially identical to the axial spacing of the port end surface 59 from the transverse surface 73. As a result, the port end surface 59 is aligned, axially, with the end wall 29 of the bearing plate 15, if there is no relief chamber 29R. However, with a relief chamber 29R being provided in the subject embodiment, the port end surface 59 is preferably aligned axially with the relief surface 29R of the relief chamber. In either case, the port end surface 59 is disposed as far "forward" (i.e., toward the outlet end 65) as the forward most surface which bounds the cylindrical chambers 31 and 33 so that there is no "bar" as in the prior art against which air impinges as it is transferred from between the rotor lobes and through the outlet port 53. Therefore, it should be understood that as used hereinafter in the claims, the term "inside end surface" refers to the end surface 29 if there is no relief chamber, or refers to the relief surface 29R if there is a relief chamber.

EXAMPLE

Referring now primarily to FIG. 6, there is a graph comparing the performance of the invention as shown in FIGS. 1–5 with that of the prior art, made in accordance with the above-incorporated patents. More specifically, the testing which led to the graph of FIG. 6 was performed on a pair of Roots-blower superchargers sold commercially by the assignee of the present invention under the designation "Model 45". FIG. 6 is a graph of isentropic efficiency (as a percent) versus supercharger speed (i.e., speed of the input shaft 47). The devices (the "prior art" and the "invention") being compared in the graph of FIG. 6 were operated at both 5 psi boost pressure and 10 psi boost pressure. In connection with the superchargers produced commercially by the assignee of the present invention, a boost pressure of 10 psi is considered to be a "full boost". Therefore, the graph of FIG. 6 involves testing the devices at full boost and at approximately half boost.

As was mentioned in the BACKGROUND OF THE DISCLOSURE, it is an object of the invention to increase isentropic efficiency of the blower. The isentropic efficiency of a device is the actual performance of the device (e.g., work output) as a percent of that which would be achieved under theoretically ideal circumstances (i.e., if no heat loss occurred in the system). In other words, in the case of a supercharger, the isentropic efficiency is an indication of the amount of input energy being wasted as heat.

As may be seen in FIG. 6, at the 5 psi boost level the invention and the prior art are both substantially 74% efficient at 4000 RPM, but when the supercharger speed has reached 14000 RPM, the prior art device has dropped to 45% efficient while the device of the invention is still slightly above 52% efficient.

At the full 10 psi boost, the prior art device is about 65% efficient at 4000 RPM while the invention is about 69% efficient, with the difference therebetween increasing until, at 14000 RPM, the prior art device has dropped to 51% efficiency, while the device of the invention is slightly above 58% efficiency.

Thus, it may be seen that at either full boost or at merely a partial boost, the device of the present invention is substantially more efficient than the prior art device, and is more efficient over the entire range of operation. Furthermore, the advantage of the invention over the prior art increases at high blower speeds, which is the situation where isentropic efficiency is of greatest concern.

Although the present invention has been described in connection with an embodiment in which the bearing plate 15 and the housing member 13 comprise separate members, it should be understood that such is not an essential feature of the invention. As was mentioned previously, the backplate portion 49 could comprise a member separate from the housing portion 50, and bolted thereto. In that case, and within the scope of the present invention, the housing portion 50 could be formed integrally with the bearing plate portion 15, and the overall configuration of the housing portion 50 and the bearing plate 15 would still be identical to what is shown in FIG. 2. More importantly, for purposes of the present invention, the relationship of the port end surface 59 to the end surface 29 or to the relief surface 29R would still be as described in connection with the primary embodiment.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A rotary blower of the backflow type comprising a housing assembly including a housing member and a bearing plate disposed at an outlet end of said housing member; said housing member defining an inlet end wall portion and a housing portion defining two parallel, transversely overlapping cylindrical chambers, the axes of the cylindrical chambers defining a longitudinal direction; said bearing plate defining an inside end surface, said cylindrical chambers being bounded at said outlet end by said inside surface; said housing member defining an inlet port disposed generally toward said inlet end wall portion, said housing member further defining an outlet port disposed generally toward said outlet end; a pair of meshed, rotors rotatably disposed in said cylindrical chambers, each of said rotors including lobes having lead ends disposed adjacent said inlet end wall portion and trailing ends disposed adjacent said bearing plate, meshing of said lobes of said rotors effecting transfer of volumes of compressible inlet port fluid to said outlet port by means of spaces between adjacent unmeshed lobes of each rotor; said housing member being open at said outlet end, and said outlet port defining a port end surface oriented generally perpendicular to said longitudinal direction, said bearing plate being fixedly attached to said housing member adjacent said open outlet end; characterized by:

(a) said open outlet end of said housing member defining a receiving portion comprising a counterbore;

(b) said bearing plate defining a stepped outer periphery disposed within said counterbore, whereby said port end surface of said outlet port lies approximately in a plane defined by said inside end surface of said bearing plate.

2. A rotary blower as claimed in claim 1, characterized by said open outlet end of said housing member defining a first transverse surface portion disposed in face-to-face engagement with a first transverse surface portion defined by said outer periphery of said bearing plate, said face-to-face engagement establishing the relative axial position of said housing member and said bearing plate.

3. A rotary blower as claimed in claim 2, characterized by said open outlet end of said housing member defining a second transverse surface portion disposed in face-to-face engagement with said inside end surface of said bearing plate.

4. A rotary blower as claimed in claim 1, characterized by each of said lobes of said rotors defines a helical twist from said lead ends to said trailing ends, whereby meshing of said lobes of said rotors transfers volumes of fluid axially from said lead ends to said trailing ends.

5. A rotary blower as claimed in claim 4, characterized by said inside end surface of said bearing plate being axially spaced apart from said trailing ends of said lobes of said rotors to define a relief chamber between said bearing plate and said rotors.

6. A rotary blower as claimed in claim 1, characterized by said outlet port being defined wholly by said housing portion defining said cylindrical chambers.

7. A rotary blower as claimed in claim 6, characterized by said outlet port being generally triangular with said port end surface comprising the base of the triangle, said port end surface lying substantially in said plane defined by said inside end surface of said bearing plate.

* * * * *